United States Patent [19]

Sundvall

[11] Patent Number: 4,515,081

[45] Date of Patent: May 7, 1985

[54] ARRANGEMENT IN A FUSE FOR PROJECTILES WITH EXPLOSIVE CHARGE FOR CHANGING OVER BETWEEN DIRECT AND DELAYED IGNITION OF THE EXPLOSIVE CHARGE

[75] Inventor: Kenneth Sundvall, Eskilstuna, Sweden

[73] Assignee: Forenade Fabriksverken, Eskilstuna, Sweden

[21] Appl. No.: 442,155

[22] Filed: Nov. 16, 1982

[30] Foreign Application Priority Data

Nov. 16, 1981 [SE] Sweden ..... 8106780

[51] Int. Cl.[3] ..... F42C 9/00

[52] U.S. Cl. ..... 102/266; 102/210; 102/216; 102/247; 102/271

[58] Field of Search ..... 102/216, 247, 252, 262, 102/265, 266, 270, 271, 248, 249, 251, 253, 254, 255, 256, 210

[56] References Cited

U.S. PATENT DOCUMENTS

| | | | |
|---|---|---|---|
| 2,483,555 | 10/1949 | Nichols | 102/271 X |
| 2,974,598 | 3/1961 | McLean | 102/206 |
| 3,054,870 | 9/1962 | Wagoner | 102/216 X |
| 3,388,667 | 6/1968 | Voida et al. | 102/248 X |
| 3,599,572 | 8/1971 | Brackman | 102/70.2 |
| 3,771,457 | 11/1973 | Buxton | 102/262 |
| 3,780,660 | 12/1973 | Webb et al. | 102/70.2 R |
| 3,955,508 | 5/1976 | Will et al. | 102/248 X |
| 4,029,016 | 6/1977 | Cole | 102/266 X |
| 4,230,042 | 10/1980 | Popovitch | 102/271 X |

*Primary Examiner*—David H. Brown
*Assistant Examiner*—John E. Griffiths
*Attorney, Agent, or Firm*—Fleit, Jacobson, Cohn & Price

[57] ABSTRACT

Arrangement in a fuse for projectiles with explosive charge for changing over between direct and delayed ignition of the explosive charge. The arrangement includes a movable contact member which in an initial position short-circuits an electrical igniter which is designed for direct ignition of the explosive charge. A locking member in the form of a pin in an initial orientation of the projectile takes up a position in which the contact member can move under the influence of the accelerational forces effective on the projectile to a second position where the contact member is held by a detent device. With a second orientation of the projectile the pin, as a result of its own weight, drops down to a position where it prevents the contact member moving from the said initial position.

4 Claims, 9 Drawing Figures

ARRANGEMENT IN A FUSE FOR PROJECTILES WITH EXPLOSIVE CHARGE FOR CHANGING OVER BETWEEN DIRECT AND DELAYED IGNITION OF THE EXPLOSIVE CHARGE

The present invention relates to an arrangement in a fuse for projectiles with explosive charge for changing over between direct and delayed ignition of the explosive charge.

In such an arrangement there are normally two separate ignition circuits, an initial ignition circuit for direct ignition, usually consisting of an electrical circuit with an electrical igniter, and a second ignition circuit for delayed ignition, e.g. consisting of a pyrotechnic ignition chain.

The ignition circuit for delayed ignition is usually permanently connected in. The ignition circuit for direct ignition is normally inactivated by its electrical igniter being short-circuited. The change over to direct ignition is then made by interrupting the said short-circuit so that the electrical igniter is connected into the said electrical circuit.

The change over between delayed and direct ignition has, with previously known projectiles of this type, been undertaken by external actuation, e.g. the position of a device which passes through the casing of the igniter housing is changed manually before loading, or automatically during loading, or during ejection. The mechanical, and occasionally electrical arrangements, both inside and outside the projectile which are employed have proved both complicated and prone to damage.

Consequently the aim of the present invention is to provide a simpler and a more reliable arrangement for changing over between delayed and direct ignition.

By means of the invention it has become possible for the firer, before firing the projectile, to choose between delayed or direct ignition merely by selecting an appropriate orientation of the projectile in the barrel.

With an initial orientation of the projectile, the locking device adopts such a position that it prevents the electrical contact member from moving from the first to the second position, so that the electrical igniter remains short-circuited and delayed ignition of the explosive charge takes place when the projectile impacts against a target.

With a second orientation of the projectile the locking device drops down so that as a result of the accelerational forces the contact member can move to the second position and is retained there by the detect member so that the short-circuiting of the electrical igniter is interrupted, i.e. so that direct ignition of the explosive charge takes place on impact.

The invention will be described in greater detail in the following by reference to the appended drawings which illustrate a preferred embodiment of the invention.

The direction of firing of the projectile is indicated in the diagrams by an arrow S.

Figure 1:
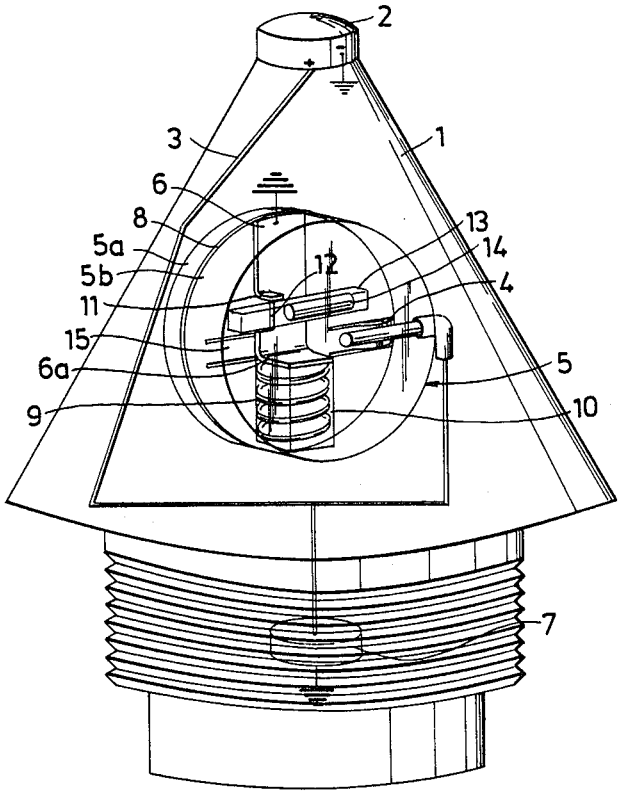
FIG. 1 shows in perspective an X-ray view of a fuse with an arrangement in accordance with the invention.
Figure 3:
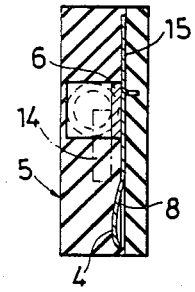
FIG. 3 shows the section along the line III—III in FIG. 2.

FIG. 1 shows schematically a fuse 1 which is designed to be screwed into a projectile body which is not illustrated. The ignition circuit for direct ignition comprises an electrical circuit with a supply source 2, e.g. a piezoelectrical generator, the positive pole of which is connected via a conductor 3 with an input connection 4 on the change over device in accordance with the invention which is generally designated as 5. The change over arrangement 5 has an output connection with comprises a moveable contact member in the form of a piston 6 which on one side is connected with the input connection 4 and on the other side with the body of the fuse, which in FIG. 1 is indicated by the symbol for earth.

An electrical igniter 7, indicated schematically, is connected between the conductor 3 and the body of the fuse 1. The negative pole of the supply source 2 is also connected to the body of the fuse, so that this serves as the return conductor in the ignition circuit. The method of igniting an explosive charge by means of an electrical igniter is generally known and employed, so that it has not been described here. For the same reason it has not been regarded as necessary to indicate the location of the explosive charge on the drawing.

The ignition circuit for delayed ignition is not shown on the drawing. This can for example comprise in a known manner a pyrotechnic ignition chain with delay unit which is initiated mechanically when the projectile impacts against a target.

The change over arrangement 5 comprises a housing, resembling a platform, consisting of two round plates 5*a* and 5*b*, which are joined together, made from an electrically insulating material, e.g. transparent plastic. The centre axis of the platform-like housing 5 is orientated at right angles to the longitudinal axis of the projectile.

Between the plates 5*a* and 5*b* there is a circular contact metal plate 8 having a cut out tongue which rests resiliently against the conductor 3 and forms the said input connection 4 in the electrical ignition circuit. The diameter of the plate 8 is somewhat less than that of the housing 5 and the plate is located at some distance from the body of the fuse 1 so as to be insulated from the latter.

The piston 6 comprises a plate which is bent into L-shape which under the effect of the accelerational forces imposed on the projectile can move rearwards against the effect of a spring 9 in a channel 10 which runs parallel with the longitudinal axis of the projectile and is incorporated in the housing 5.

The longer arm of the L-shaped piston 6 extends in the longitudinal direction of channel 10 whilst its shorter arm 6*a*, located furthest to the rear, is bent at a right angle. Hence the rear portion of channel 10 is enlarged so as to permit the displacement of the piston 6.

The longer arm of piston 6 is provided with an upwardly-folded tongue 11, the function of which will be described later. By bending the tongue 11 upwards a recess 12 is formed in the piston 6, the function of which will also be described later.

The housing 5 also contains a channel 13, which is at right angles to channel 10 and proceeds straight across the recess 12, in which channel a locking member in the form of a pin 14 is displaceably arranged. The channel 13 has a dimension somewhat greater than that of the pin 14 so that this pin can be moved easily inside channel 13.

Figure 2:
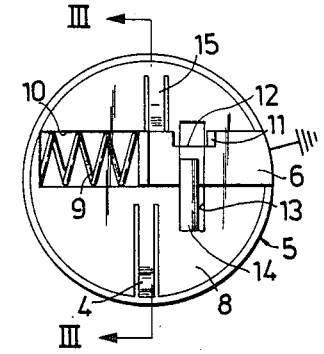
FIG. 2 shows an X-ray view from the side of the arrangement illustrated in FIG. 1, with an initial orientation of the projectile in the at-rest position.
Figure 6:
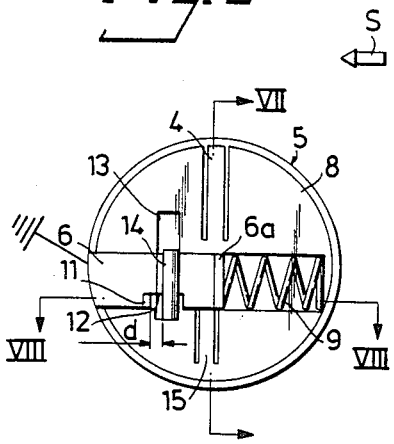
FIG. 6 shows the same X-ray view as in FIG. 2, but with the projectile rotated 180° around its axis.
Figure 7:
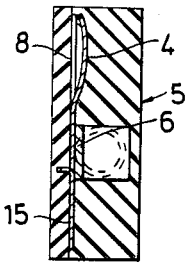
FIGS. 7 and 8 show a section along the line VII and VIII respectively in FIG. 6.
Figure 8:
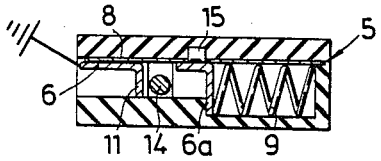
Figure 9:
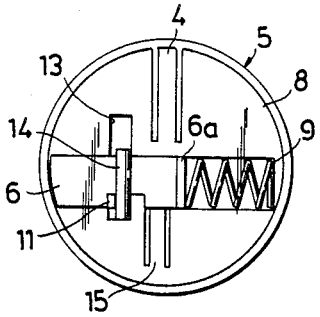
FIG. 9 shows the same X-ray view as in FIG. 6, but during the ejection phase of the projectile.

The task of the locking member 14 is, with an initial orientation of the projectile, to interact with the tongue 11 so as to prevent the piston 6 moving from the position illustrated in FIG. 2. In a practical embodiment, as shown inter alia by FIG. 6, it is here appropriate to have the pin 14 at some slight distance d from the tongue 11 so that the movement of the pin 14 in channel 13 is not impeded. When accelerational forces occur, the piston 6 can then move along the distance d until the tongue 11 is stopped by pin 14, as shown in FIG. 9. When the acceleration decreases, the piston 6 reverts to the position shown in FIG. 6 under the influence of the spring 9.

The metal contact plate 8 is provided with a L-shaped tongue 15 which when the projectile is at rest is held by spring force against one face of the piston 6.

The function of the change over arrangement 5 is as follows.

Figure 5:
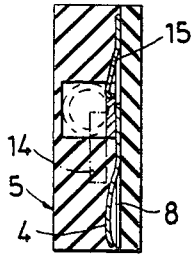
FIG. 5 illustrates a section along the line V—V in FIG. 4.
Figure 4:
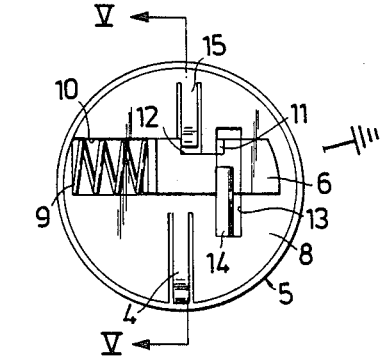
FIG. 4 shows the same X-ray view as in FIG. 2, but during the ejection phase of the projectile.

If the firer wishes to set up direct ignition of the explosive charge, he orientates the projectile so that the pin 14 drops under its own weight down into one position in channel 10, illustrated in FIGS. 1 and 2. During ejection of the projectile accelerational forces prevail which move the piston 6 to the rear. The detent member (the pin 14) does not prevent the movement of the piston 6, because the tongue 11 is not held by the pin 14. When the piston 6 has moved so far to the rear that the tongue 15 is in the centre of the recess 12 in piston 6, the tongue 15 snaps into the recess 12 so that the piston 6 is locked in this position (see FIGS. 4 and 5). The electrical contact between the piston 6 and the body of the fuse 1 is now broken, i.e. the supply source 2 is now connected with the electrical igniter 7 so that direct ignition of the explosive charge, which is not illustrated, occurs when the projectile hits its target.

If on the other hand the firer wishes to set up delayed ignition of the explosive charge, he rotates the projectile through 180° around its longitudinal axis. As a result the pin 14 drops down into the other end of channel 13, see FIG. 6, so that it is now located in the path of tongue 11. When the projectile is ejected the piston 6 travels the distance d until the tongue 11 knocks against the pin 14, see FIG. 9, so that the piston 6 is prevented from moving further. As soon as acceleration ceases the piston 6 reverts to the position illustrated in FIG. 6 under the force of spring 9. By this means the piston 6 remains in contact with the body of the fuse, i.e. the electrical igniter 7 remains short-circuited, so that delayed ignition of the explosive charge takes place via the ignition circuit for delayed ignition, which is not illustrated.

In accordance with a modified embodiment of the invention the pin 6 can be replaced by a ball or an arrangement which slides along a rail.

The invention is not restricted to the embodiments illustrated and described, a large number of modifications thereof being feasible within the framework of the appended claims.

I claim:

1. A fuse for an ignitor circuit of a projectile having an explosive charge, said ignitor circuit being changeable by said fuse between a direct and delayed ignition of said explosive charge, said fuse comprising:

a body being electrically conducting, a cavity defined by said body, a housing mounted in said cavity, said housing being electrically insulating, a first channel defined by said housing, said first channel extending parallel to a longitudinal axis of said body, means defining an electrically conductive path and a tongue, said means being located in said housing, a power source having one pole for electrical connection to said igniter circuit and said means and an opposite pole electrically connected to said body, an electrical contact member slidingly mounted in said first channel and electrically contacting said contact means, said electrical contact member being biased for engagement with said body, the electrical contact member being movable in the first channel under accelerational forces effected on the fuse for moving from an initial position contacting the body and short-circuiting the electrical ignitor circuit to a second position where the electrical contact member interrupts the short-circuit of the electrical ignitor circuit by engaging said tongue, spring means for biasing said electrical contact member into electrical contact with said body, a second channel defined by said housing located transversely to said first channel, and locking means slidable in said second channel between two positions, one position prevents said electrical contact member from being restrained from electric contact with said body for short-circuiting the electrical ignitor circuit and the other position permits said electrical contact member to be restrained from electric contact with said body and interrupting the short-circuiting of the electrical ignitor circuit.

2. A fuse as claimed in claim 1, wherein said locking means is a pin.

3. A fuse as claimed in claim 1, wherein said locking means is slidable in said scond channel under the influence of gravitational forces.

4. A fuse as claimed in claim 3, wherein said locking means is slidable between said two positions by rotation of said body by 180°.

* * * * *